United States Patent [19]

Pritz

[11] 3,958,694

[45] May 25, 1976

[54] MERCHANDISE DISPLAY WITH SECURITY LOCK

[76] Inventor: Peter G. Pritz, c/o Trico Non Ferrous Metal Products, Inc., Wyandotte Road, Willow Grove, Pa. 19090

[22] Filed: Dec. 27, 1974

[21] Appl. No.: 536,908

[52] U.S. Cl. ..... 211/4; 248/203; 70/59

[51] Int. Cl.[2] ..... E05B 73/00

[58] Field of Search ..... 211/4, 7, 8, 9, 60 R, 211/60 SK, 64; 248/203; 292/336; 70/59, 61, 62, 183; 43/22, 26

[56] References Cited

UNITED STATES PATENTS

| | | | |
|---|---|---|---|
| 524,923 | 8/1894 | Whitfield | 70/59 |
| 913,188 | 2/1909 | Backus | 70/59 |
| 960,131 | 5/1910 | Wilson et al. | 70/59 |
| 2,171,682 | 9/1939 | Byrnes | 70/59 |
| 3,291,317 | 12/1966 | Bowen | 211/4 |
| 3,489,288 | 1/1970 | McDaniel | 211/7 |
| 3,567,034 | 3/1971 | Mozelsio | 211/7 |
| 3,570,676 | 3/1971 | Crosslen | 211/4 |
| 3,635,433 | 1/1972 | Anderson | 211/60 |
| 3,662,979 | 5/1972 | Lucci | 248/203 |
| 3,767,093 | 10/1973 | Pinkerton et al. | 248/203 |

FOREIGN PATENTS OR APPLICATIONS

| | | | |
|---|---|---|---|
| 180,133 | 10/1905 | Germany | 70/62 |
| 409,681 | 10/1966 | Switzerland | 70/59 |

*Primary Examiner*—Roy D. Frazier
*Assistant Examiner*—Robert A. Hafer
*Attorney, Agent, or Firm*—Zachary T. Wobensmith, 2nd; Zachary T. Wobensmith, III

[57] ABSTRACT

A merchandise display is disclosed with a security lock to prevent pilferage, the display including an elongated box on the upper or outer face of which the articles are mounted for display, with an interiorly disposed rotatable locking rod, key operated for locking and release of the articles.

10 Claims, 9 Drawing Figures

IMPROVEMENTS IN MERCHANDISE DISPLAY WITH SECURITY LOCK

BACKGROUND OF THE INVENTION

1. Field of the Invention

This invention relates to a merchandise display in the form of a box-like rack with a security lock for retaining articles, of merchandise against unauthorized removal, the display being particularly useful for but not limited to use with fishing reels.

2. Description of the Prior Art

It has heretofore been proposed, as in the U.S. Patent to MacMillan, No. 867,966, to provide a lockable display stand of tubular material with struck out hook portions to engage articles to be displayed and with an internally disposed keeper rod, capable of being locked in secured position, and engaging an article in or on the struck out hook portion. The struck out portions, unless of very heavy material, could be bent with a screw driver or the like to release the article in spite of the engagement by the keeper. This structure, also, is limited as to the character of articles to be supported, by the necessity for carrying the article on the hook.

It has also heretofore been proposed, as in the U.S. Patent to Andrews, No. 3,204,362 to mount and secure fishing rods and reels.

Fischer, U.S. Pat. No. 2,041,749, McDaniel, U.S. Pat. No. 3,489,288, and Modrey, U.S. Pat. No. 2,889,050 show typical merchandise displays with locks to prevent pilferage.

The merchandise displays with security locks heretofore available had various shortcomings including lack of security, limitations as to the mounting of the articles to be displayed, excessive cost of manufacture, and restriction as to the location of use.

SUMMARY OF THE INVENTION

In accordance with the invention, a merchandise display is provided preferably in the form of a closed elongated box of stamped sheet metal capable of being mounted vertically or horizontally, with a front face having struck-out sockets for the reception of spaced portions of an article, such as the ends of the rod engaging and mounting portions of a fishing reel, a locking rod, spring operated in one direction and key operated in the other being provided in the interior of the box with locking pins for holding the articles in the sockets, the rod normally being spring urged to locking position, a slidable plate accessible for operation from the front faces holding the locking pins against the force of the spring out of locking engagement with the articles.

It is the principal object of the invention to provide a merchandise display having structure for preventing pilferage which is simple in construction yet reliable in its operation.

It is a further object of the invention to provide a merchandise display of the character aforesaid which has a higher order of security and protection of the merchandise than many of the structures heretofore available.

It is a further object of the invention to provide a merchandise display of the character aforesaid in which the retention against unauthorized removal is easily controlled.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
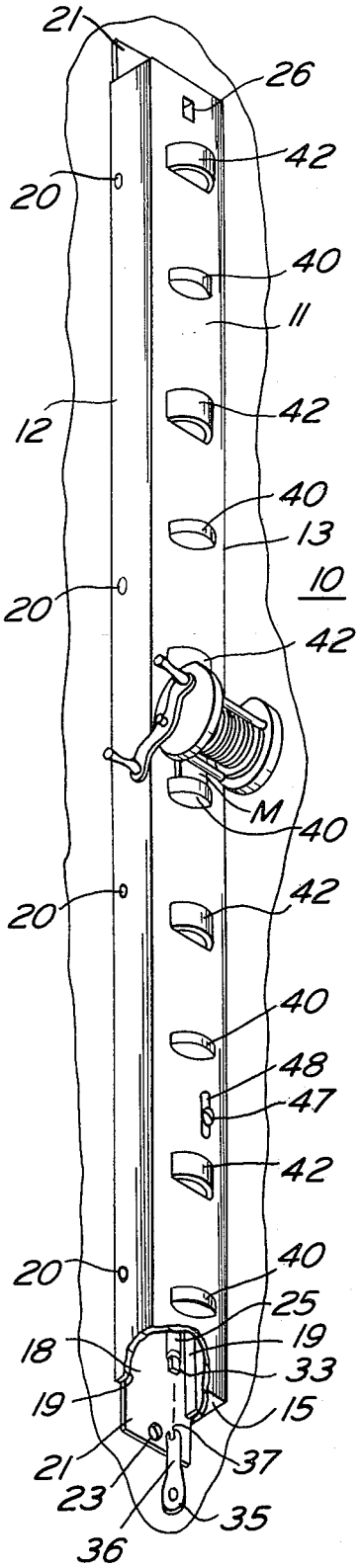
FIG. 1 is a view in perspective of a merchandise display in accordance with the invention, parts being broken away to show the details of construction.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, the merchandise display in accordance with the invention preferably includes an elongated box like housing 10 having a front wall 11, side walls 12 and 13, an end wall 14 which may serve as a top wall and an end wall 15 which may serve as a bottom wall. The housing 10 is preferably formed as a stamping of sheet metal.

A rear or bottom closure wall 18 is provided, also preferably formed as a stamping of sheet metal having side flanges 19 to which the side walls 12 and 13 are secured in any desired manner such as by pop rivets 20. The wall 18 has end extensions 21 beyond the end walls 14 and 15 with openings 22 for securing the housing 10 in a vertically upright position, in a horizontal position or inclined, if desired, by screws 23 or other fasteners.

A locking rod 25 is provided rotatably carried at one end which may be the upper end adjacent and inwardly of the end wall 14 by a lug 26 struck in from the front wall 11. The locking rod 25 at its opposite end has a shoulder 27 resting on a lug 28 struck in from the front wall 11 adjacent and inwardly of the end wall 15.

The rod 25 contiguous to the lug 26 has a pin 29, preferably a cotter pin, extending through an opening 30 in the rod 25. The eye end of the pin 29 serves for the attachment of one end of a tension spring 31, the other end of the spring 31 being engaged with a hooked lug 32 struck in from the side wall 13. The eye end of the pin 29 by its engagement with the interior of the wall 11 can serve as a limit stop in one direction of rotation of the rod 25 and the bifurcated end of the pin 29 by its engagement with the interior of the wall 11 can serve as a limit stop in the other direction of rotation of the rod 25 urged by the spring 31.

The terminal end 33 of the rod 25 inwardly of the wall 15 is preferably flattened and shaped like a screw driver bit and is accessible through an opening 34 in the end wall 15 for operation by a key 35 having a tubular portion 36 with a cross slot 37 for engagement with the rod end 33.

The front wall 11 is provided with a plurality of transversely arcuate integral sockets 40 formed as outward protuberances, and preferably closed at their ends disposed toward the wall 15. In longitudinally spaced relation to the sockets 40 on the front wall 11, additional sockets in the form of integral arcuate bands 42 are provided open toward the open portion of the sockets 40 and at least partially closed at their other ends as at 43. The bands 42 are preferably longer, longitudinally of the front wall 11 than the sockets 40 to permit of the insertion thereinto of one end of an elongated article such as the mounting plate M of a fishing reel to an extent to engage the interior of the band end 43, the other end of the elongated article first clearing the socket 40 and then being slid into the socket 40 while still restrained by the band 42 where it is retained in a vertical, horizontal or tilted position of the housing 10.

Figure 2:
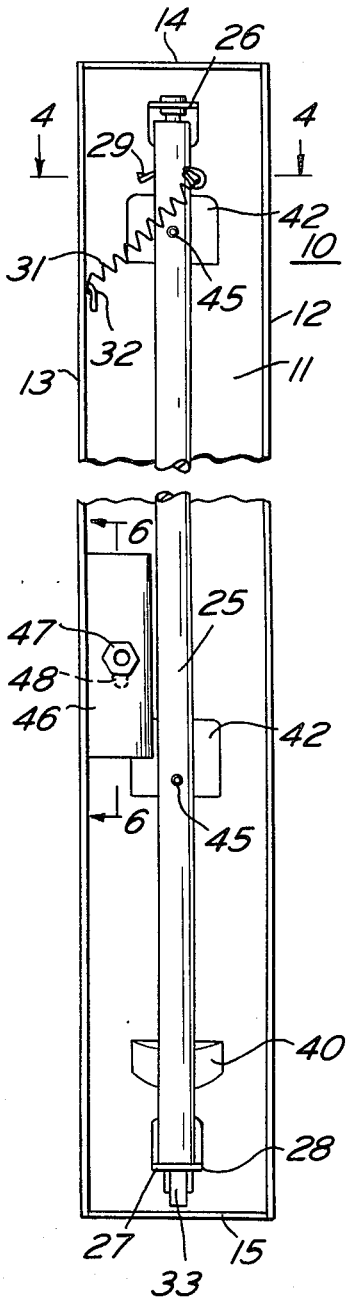
FIG. 2 is a view in elevation as seen from the rear and with the rear closure plate removed.
Figure 3:
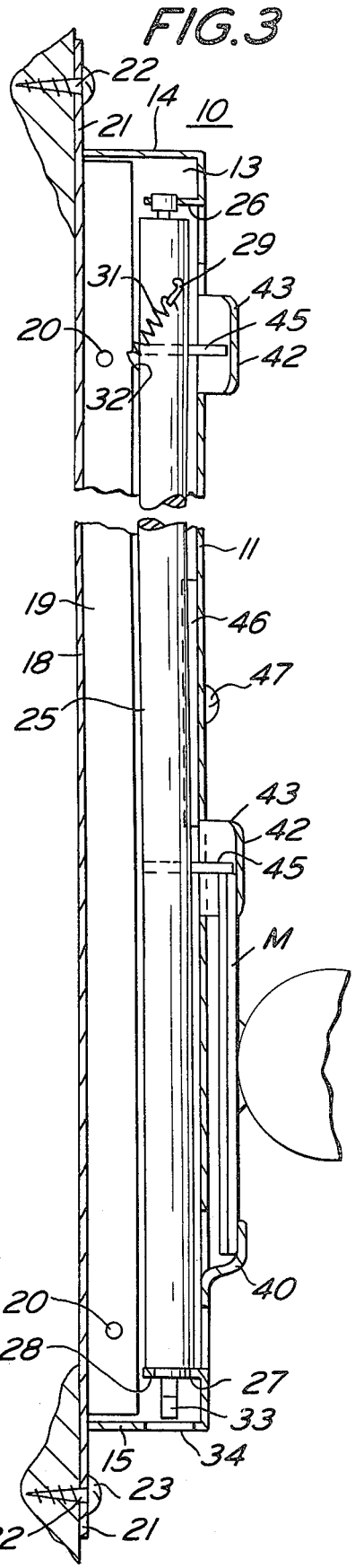
FIG. 3 is a longitudinal central sectional view showing the locking rod in locking position.
Figure 4:
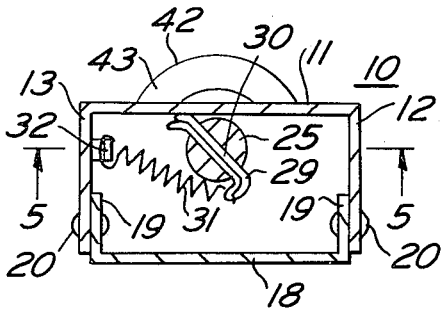
FIG. 4 is a fragmentary transverse sectional view taken approximately on the line 4—4 of FIG. 2.
Figure 9:
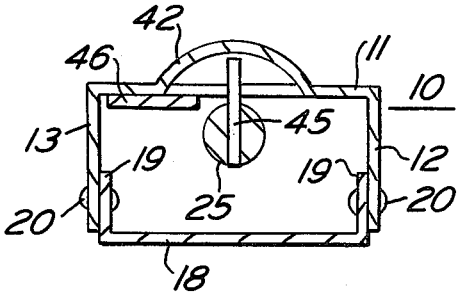
FIG. 9 is a view similar to FIG. 8 but showing one of the locking pins in locked position as in FIG. 3.

The locking rod 25 is provided with a plurality of radially outwardly extending locking pins 45, one preferably being located substantially centrally of each band 44. It will be noted that the pins 45 are movable, urged by the spring 31 into positions as shown in FIGS. 2, 3 and 9 for locking engagement with one end of the article M to be protected, the other end of the article M being simultaneously held in the socket 40.

In order to hold the locking pins 45 out of their locking positions, a slide plate 46 is provided, carried on a mounting bolt 47. The bolt 47 is slidable in an elongated slot 48 in the front wall 11 and is movable to one limit position as indicated in FIGS. 2 and 3, where it is positioned so that the contiguous pin 45 cannot engage therewith, and the pins 45 are moved to an article locking condition as in FIG. 9.

Figure 7:
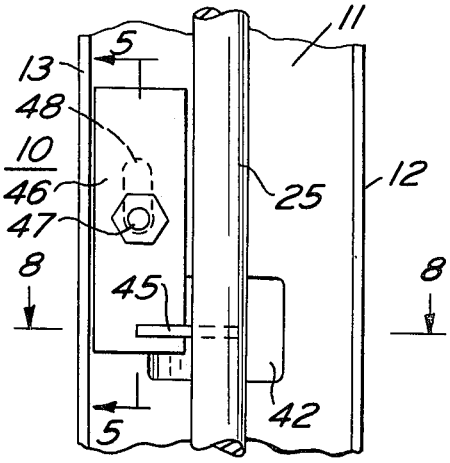
FIG. 7 is a fragmentary view in elevation of a portion of FIG. 2, enlarged, and showing the locking rod and slide plate with the locking pins held out of locked position.
Figure 5:
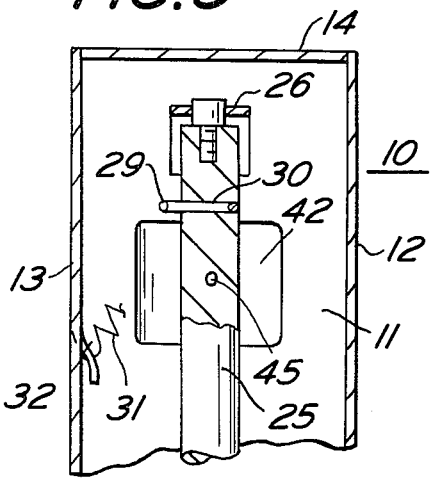
FIG. 5 is a fragmentary longitudinal sectional view taken approximately on the line 5—5 of FIG. 4.
Figure 8:
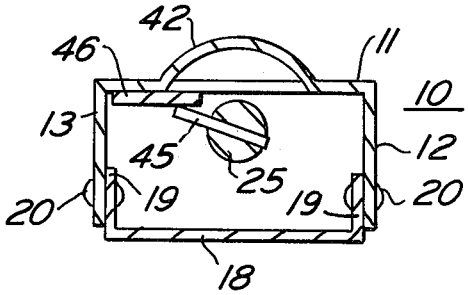
FIG. 8 is a transverse sectional view taken approximately on the line 8—8 of FIG. 2 and showing one of the locking pins held out of locked position.
Figure 6:
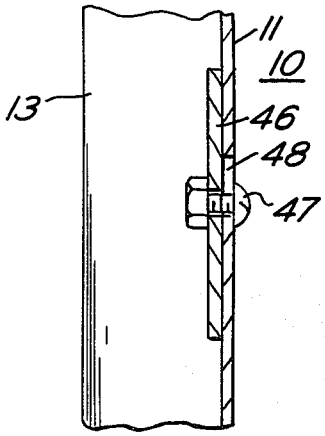
FIG. 6 is a fragmentary transverse sectional view taken approximately on the line 6—6 of FIG. 2 and showing the slide plate in its upper position.

The slide plate 46 is also movable to another limit position, as indicated in FIGS. 7 and 8, where it is positioned so that the pins 45 are held out of article locking condition.

The mode of operation will now be pointed out.

The key 35 is engaged with the rod end 33, the rod 25 turned counterclockwise at the end wall 15 and against the force of the spring 31 and the pin 45 contiguous to the slide plate 46 moved from the locking position of FIG. 9 to the position shown in FIG. 8, the slide plate 46 being moved toward the end plate 15 so as to hold the locking pin 45 out of locking position. The key 35 is then removed.

The articles to be supported and displayed are mounted each with one of its ends in the sockets 40 and with its opposite mounting end within the bands 42 as illustrated in FIG. 1.

The articles can be left in their unsecured condition with the slide plate 46 holding the locking pins 45 as illustrated in FIG. 8.

If desired, at this time or subsequently, the slide plate 46 can be moved by movement of the bolt 47 in the slot 48 away from the end plate 15 to release the locking pin 45 (FIGS. 7 and 8) so that it moves urged by the spring 31, to the locking position shown in FIGS. 3 and 9 and in engagement with one end of the article while the other end is held in the socket 40.

The articles will then be securely held against pilferage, the socket 40 and band 42 preventing access for removal of the articles and the locking bar 25 and its pins 45 being difficult of access for release.

By turning of the key 35 counterclockwise the articles can be readily released for examination by a prospective purchaser.

While the articles shown are fishing reels other objects having end portions could be stored and retained if desired.

I claim:

1. A merchandise display for articles to be protected from pilferage comprising an enclosing housing portion having an elongated front wall with at least one pair of spaced sockets having openings facing toward each other and extending outwardly from the front wall for the reception of spaced portions of the article to be displayed, one of said sockets having an end abutment for contact by one of the spaced portions of the article, a locking rod longitudinally disposed within said housing and extending beyond said sockets and pivotally mounted in said housing, said locking rod having an operating portion accessible through one end of said housing for movement thereof, said locking rod having a locking pin rigidly secured thereto and movable to a position in locking engagement with another of the spaced portions of the article within the other of said sockets and to an out of locking engagement position, a resilient member connected to said rod for rotating said locking rod in a predetermined direction, and means for releasably holding said locking rod against movement by said resilient member.

2. A merchandise display as defined in claim 1 in which said housing portion has front, side, end and rear enclosing walls, and one of said walls has a keyhole opening therethrough for access to said locking rod.

3. A merchandise display as defined in claim 1 in which said resilient member is a spring one end of which is secured by a pin member to said rod and the other end of which is engaged with said housing.

4. A merchandise display as defined in claim 3 in which said pin member by engagement of its respective ends with portions of the interior of said housing provides limit stops for limiting the turning of said locking rod.

5. A merchandise display as defined in claim 1 in which said locking rod is pivotally mounted on lugs carried by said housing.

6. A merchandise display as defined in claim 5 in which said housing has a plurality of enclosing walls, and said lugs are struck in from one of said walls.

7. A merchandise display as defined in claim 1 in which one of said spaced sockets has a closed end and the other is a band, and said locking pin is movable within said band to holding and release positions with respect to said article.

8. A merchandise display as defined in claim 2 in which one of said walls has extensions for mounting said housing.

9. A merchandise display for articles to be protected from pilferage comprising an enclosing housing portion having an elongated front wall with spaced portions on the exterior thereof for the reception of spaced portions of the article to be displayed, a locking rod longitudinally disposed within said housing and pivotally mounted therein, said locking rod having an operating portion accessible through one end of said housing for movement thereof, said locking rod having a locking pin for locking engagement with an article within at least one of said spaced portions, a resilient member connected to said rod for rotating said locking rod in a predetermined direction, and means for releasably holding said locking rod against movement by said resilient member, said last mentioned means comprising a slide plate mounted on one of said walls for movement with respect thereto, said slide plate having a portion for engagement by a locking pin on said locking rod releasably holding said locking rod in an unlocked condition.

10. A merchandise display as defined in claim 9 in which said slide plate is mounted on said front wall.

* * * * *